US006165009A

United States Patent [19]

Anbo et al.

[11] Patent Number: 6,165,009

[45] **Date of Patent: *Dec. 26, 2000**

[54] HOUSING ACCOMODATING A PLURALITY OF FLAT CABLES

[75] Inventors: Tsugio Anbo; Katsuzi Shimazawa; Yukifumi Machida; Yoshikatsu Hasegawa, all of Tokyo, Japan

[73] Assignee: Ryosei Electro-Circuit Systems Ltd., Tokyo, Japan

[ * ] Notice: This patent is subject to a terminal disclaimer.

[21] Appl. No.: 09/030,069

[22] Filed: Feb. 25, 1998

[30] Foreign Application Priority Data

Mar. 5, 1997 [JP] Japan ..... 9-067265

[51] Int. Cl.[7] ..... H01R 12/24

[52] U.S. Cl. ..... 439/498; 439/379; 439/289; 439/953; 439/499

[58] Field of Search ..... 439/247, 248, 439/498, 499, 492, 701, 685, 287, 77, 404, 405, 493, 59, 67, 76.1, 329

[56] References Cited

U.S. PATENT DOCUMENTS 3,873,172 3/1975 Paullus ..... 439/498

4,975,068 12/1990 Squires ..... 439/67

5,205,740 4/1993 Frankeny et al. ..... 439/67

*Primary Examiner*—Neil Abrams

*Assistant Examiner*—Michael C. Zarroli

*Attorney, Agent, or Firm*—Varndell & Varndell, PLLC

[57] ABSTRACT

A connector including a reception housing which has four sector-shaped compartments defined by four radial partitions, and four sector-shaped end terminals are inserted into the four sector-shaped compartments from mutually orthogonal directions which are perpendicular to a direction in which an insertion housing is inserted into the reception housing. A number of male terminals are provided on each of the four sector-shaped end terminals, and a number of conductors of a plurality of flat cables are connected to the male terminals. On the insertion housing, a number of female terminals are provided each being connected to respective one of a number of electric wires. The male and female terminals are simultaneously coupled with each other by inserting the insertion housing into the reception housing.

12 Claims, 11 Drawing Sheets

HOUSING ACCOMODATING A PLURALITY OF FLAT CABLES

BACKGROUND OF THE INVENTION

1. Field of the Invention

The present invention relates to a connector comprising a reception housing accommodating a number of first connecting terminals connected to a number of conductors of a plurality of flat cables and an insertion housing accommodating a number of second connecting terminals connected to a number of electric wires, whereby said first and second connecting terminals are coupled with each other by inserting the insertion housing into the reception housing.

2. Related Art Statement

Recently the number of electric wires for connecting electric instruments has been increased. To this end, there is generally used a connector including reception housing and insertion housing. In order to reduce a size of the connector, connecting terminals must be accommodated within the reception housing at a very high density. Further, in order to make easy the wiring operation, a flat cable is generally used. In general, a plurality of flat cables are connected to a number of electric wires by using a connector.

However, since the number of the connecting terminals is increased, an operation for mounting or accommodating these connecting terminals within the reception housing has become very complicated and could not be performed in an effective manner. Moreover, a distance between adjacent connecting terminals has become very small, and thus these terminals could not be electrically and thermally isolated from each other in a sufficient manner.

SUMMARY OF THE INVENTION

The present invention has for its object to provide a novel and useful connector for connecting a number of conductors of a plurality of flat cables to respective electric wires, in which the above mentioned problem can be solved, a number of connecting terminals can be easily and efficiently assembled within the connector, and adjacent connecting terminals can be electrically and thermally isolated in an effective manner.

According to the invention, a connector comprising a reception housing accommodating a number of first connecting terminals connected to a number of conductors of a plurality of flat cables and an insertion housing accommodating a number of second connecting terminals connected to a number of electric wires, said first and second connecting terminals being coupled with each other by inserting the insertion housing into the reception housing, wherein said reception housing includes a plurality of compartments formed within an inner space of the reception housing, and a plurality of end terminals having said number of first connecting terminals secured thereto are inserted into said plurality of compartments from side directions perpendicular to an axial direction of the reception housing.

In a preferable embodiment of the connector according to the invention, four sector-shaped compartments are formed within the reception housing and four end terminals are inserted into said four compartments from mutually orthogonal directions in a plane perpendicular to an inserting direction of the insertion housing into the reception housing.

DESCRIPTION OF THE PREFERRED EMBODIMENTS

Now the present invention will be explained in detail with reference to the accompanying drawings.

Figure 1:
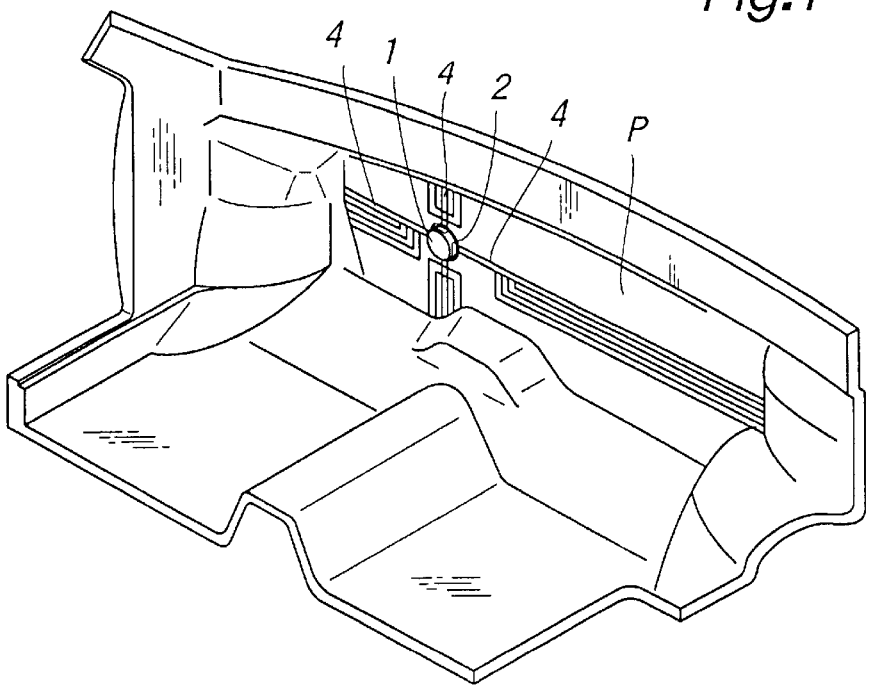
FIG. 1 is a perspective view showing an embodiment of the connector according to the invention secured to a dash panel of an automobile.
Figure 2:
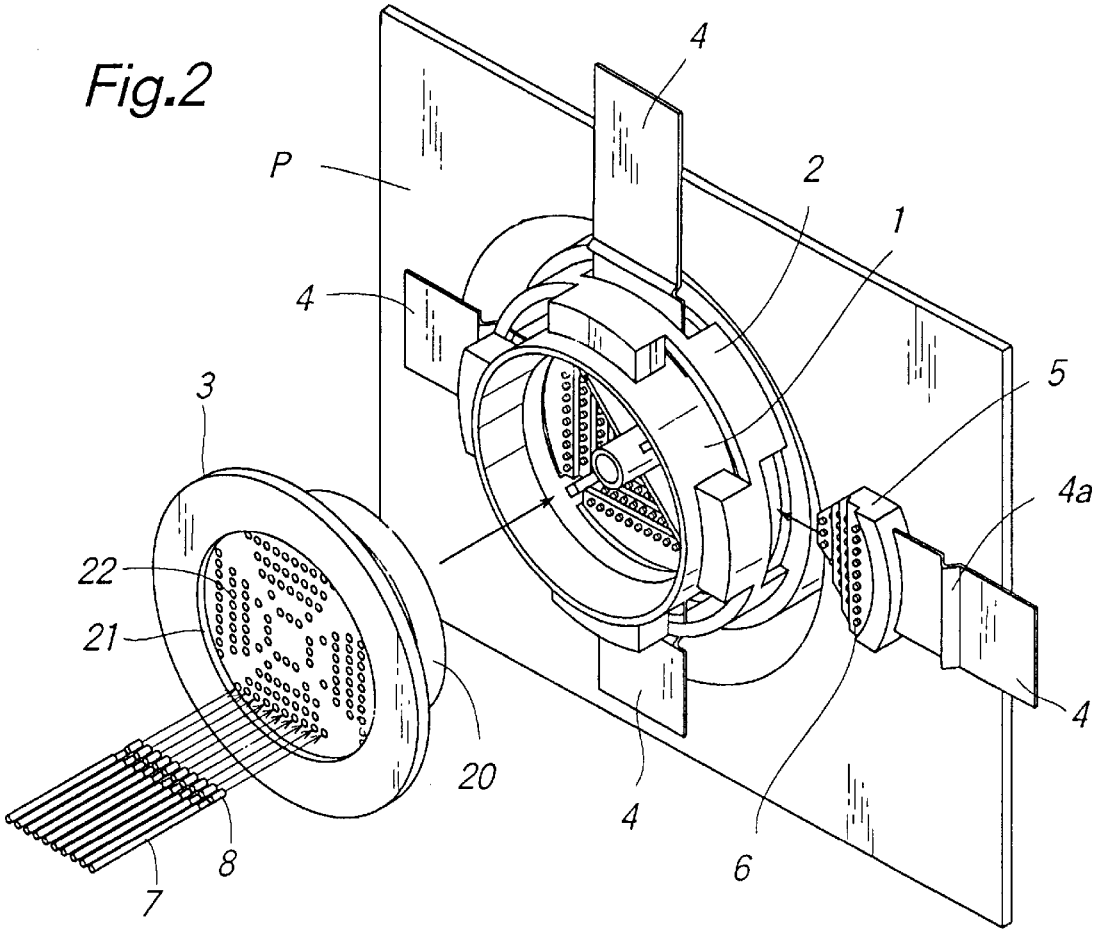
FIG. 2 is a perspective view illustrating a reception housing, an insertion housing and a bracket of the connector shown in FIG. 1.
Figure 3:
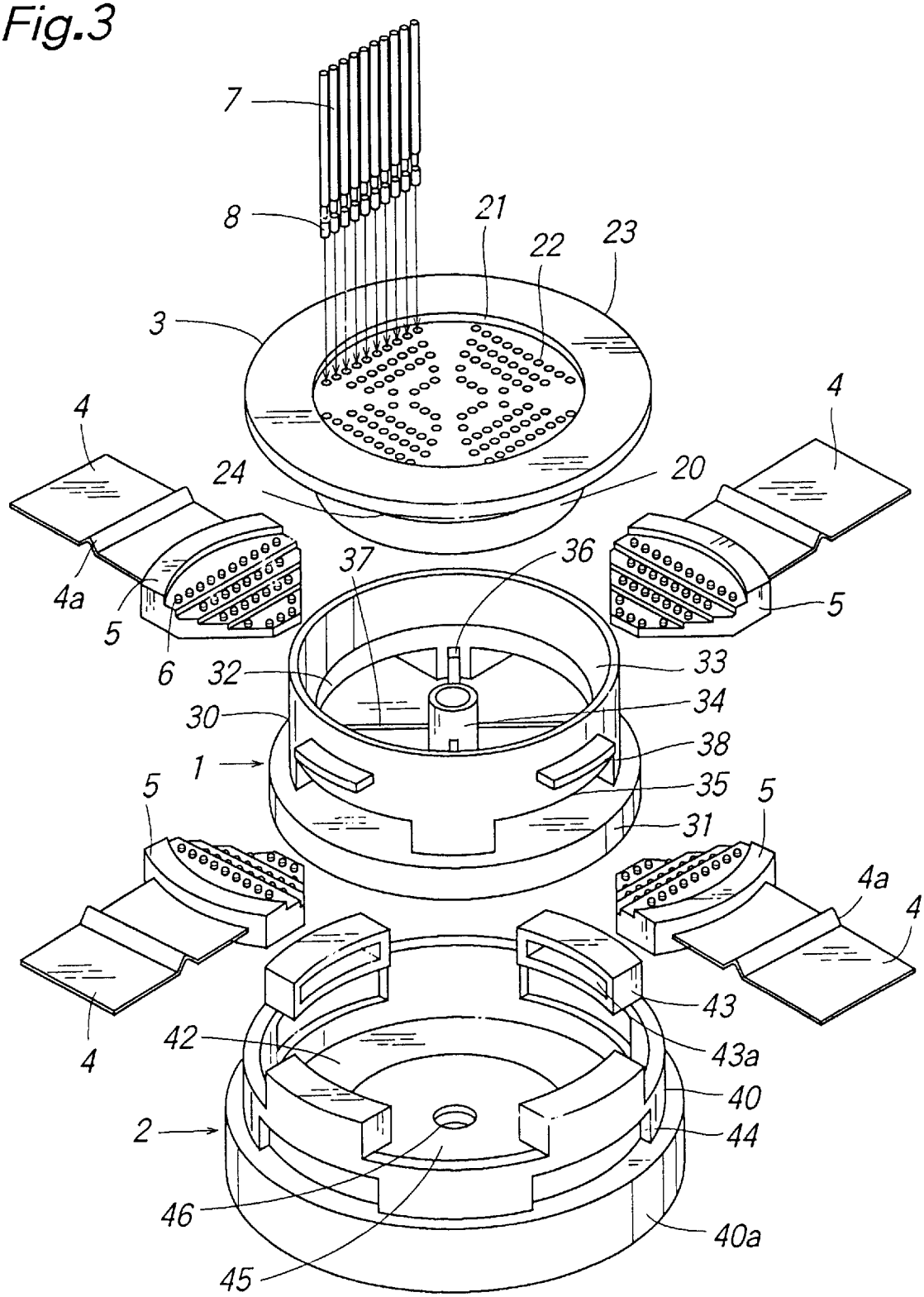
FIG. 3 is an exploded perspective view depicting the reception housing and insertion housing.
Figure 4:
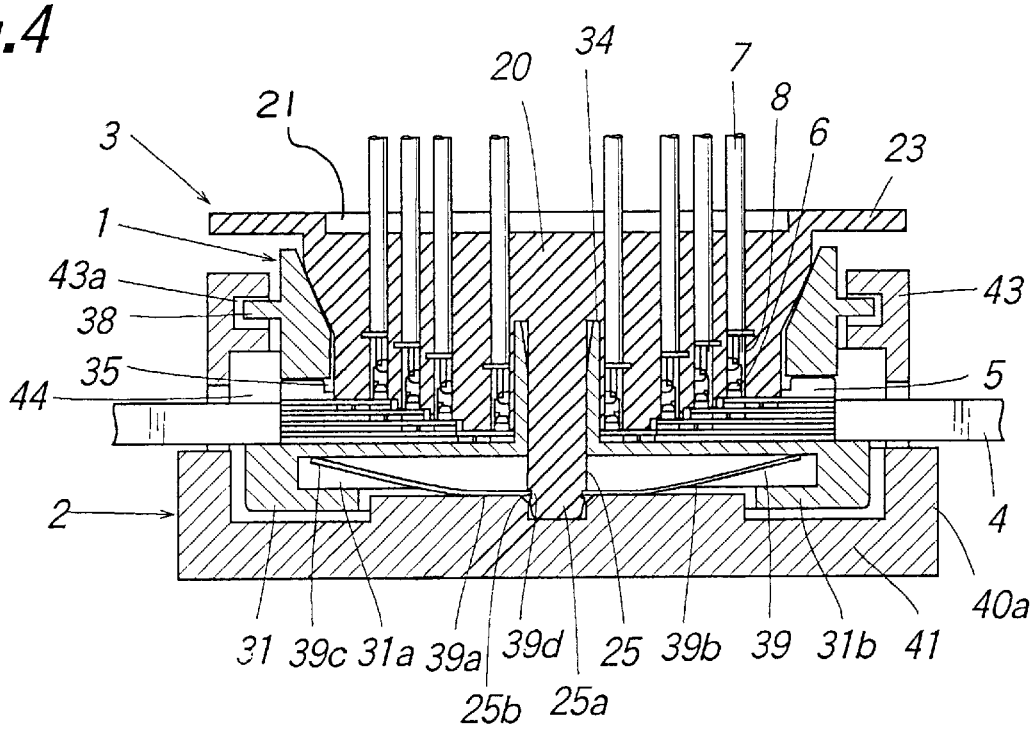
FIG. 4 is a cross sectional view showing an assembled condition of the reception housing, insertion housing and bracket.

FIG. 1 is a perspective view showing an embodiment of the connector according to the invention. The connector comprises a reception housing 1 which is fixed to a dash panel P of an automobile by means of a bracket 2. FIG. 2 is a perspective view illustrating the reception housing 1 fixed to the dash panel P and an insertion housing 3 to be inserted into the reception housing 1, FIG. 3 is an exploded perspective view depicting the reception housing 1, bracket 2 and insertion housing 3, and FIG. 4 is a cross sectional view showing a condition in which the insertion housing 3 is inserted into the reception housing 1. The bracket 1, reception housing 2 and insertion housing 3 may be formed by molds of electrically insulating plastics.

The bracket 2 is fixed to the dash panel P and the reception housing 1 is secured to the bracket 2 slightly movable up and down, right and left and back and for. The insertion housing 3 is fixed to an instrument panel not shown. Into the reception housing 1, four end terminals 5 of laminated flat cables 4 having at least one bent portions 4*a* are inserted from mutually orthogonal directions. Each of the end terminals 5 of the laminated flat cables 5 has a substantially sector shape and is made of electrically insulating plastics. The end terminal 5 has a number of male terminals 6 secured thereto. The insertion housing 3 has a number of female terminals 8 secured thereto, each of said female terminals being coupled with a respective one of said male terminals 6.

Figure 5:
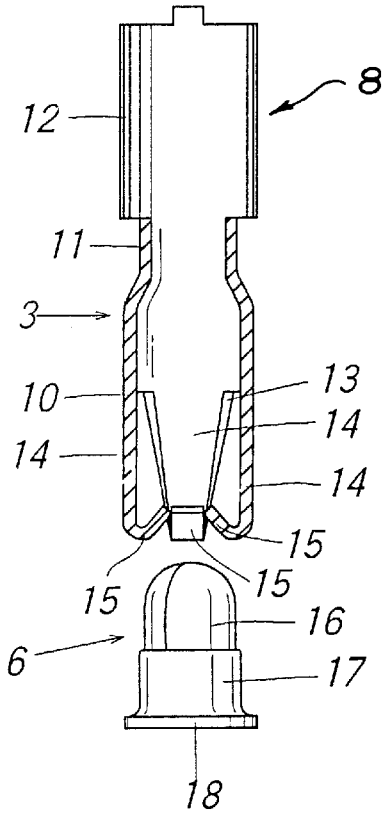
FIG. 5 is a partial cross sectional view depicting a male terminal and a female terminal.

FIG. 5 is a partial cross section of the male terminal 6 and female terminal 8 to which electric wires 7 are to be connected. The female terminal 8 comprises a terminal receiving portion 10 which receives the male terminal 6, a middle portion 11 having a relatively small width, and a clamping portion 12 to which a core conductor of an electric wire 7 is connected by clamping. The terminal receiving portion 10 has a cylindrical shape and a plurality of recesses, e.g. three recesses 13 are formed therein to form three resilient strips 14. Front ends of the strips 14 are bent inwardly to form resilient contact strips 15 which are resiliently contacted with the male terminal 6.

The male terminal 6 includes a connecting portion 16 which is to be inserted into a space defined by the resilient contact strips 15 of the female terminal 8, and an engaging portion 17 which is to be inserted into a terminal retaining hole formed in a cover for the laminated flat cable 4 as will be explained later. The round front tip of the connecting portion 16 may be formed by bending a plurality of strips, e.g. three strips extending from the engaging portion 17. The male terminal 6 further comprises a flange 18 which prevents the male terminal from being removed out of the end terminal 5.

Figure 6:
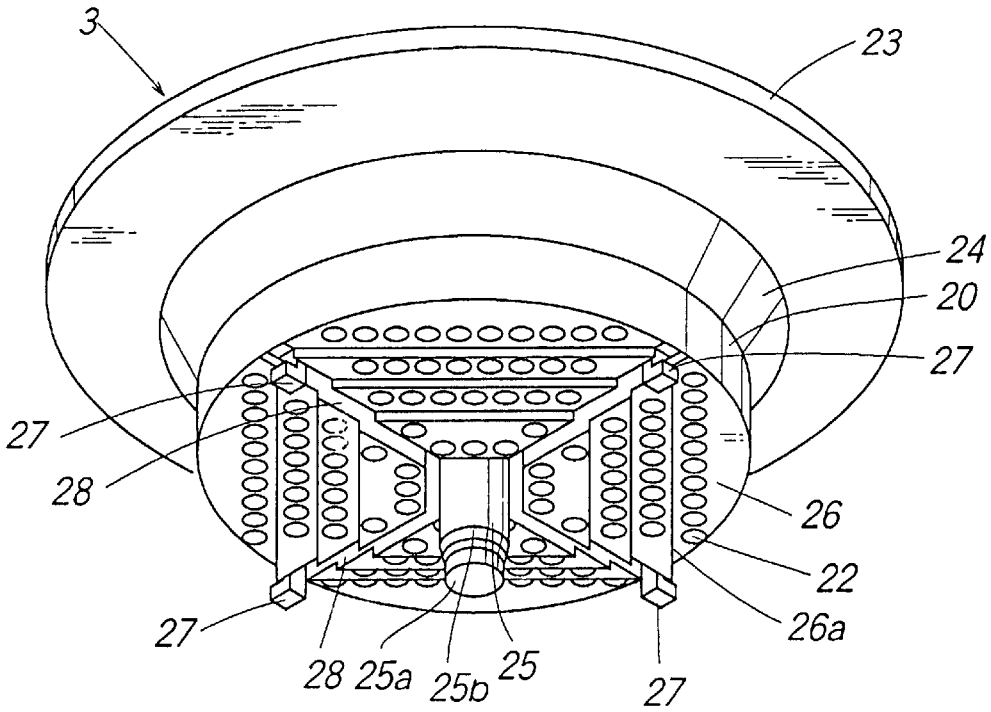
FIG. 6 is a perspective view showing the insertion housing viewed from a bottom thereof.

The insertion housing 3 comprises a cylindrical main body 20, and a recess 21 is formed in a top surface of the main body 20 as shown in FIG. 3. In the main body 20, there are formed a number of terminal retaining holes 22 for receiving the female terminals 8. These holes 22 are aligned along a plurality of lines and in each line the holes are arranged equidistantly. In each of these holes 22, a female terminal 8 is inserted such that the female terminal could not be easily removed from the hole. As shown in FIG. 6, a flange 23 is provided at an upper portion of the cylindrical main body 20. Under the flange 23, there is provided a tapered portion 24. On a bottom surface of the cylindrical main body 20, there is provided an axial portion 25 extending downwardly. At a tip of the axial portion 25, there are formed a guide portion 25*a* and a ring-shaped recess 25*b*. In the bottom surface 26 of the cylindrical main body 20, there are formed several step portions 26*a* which are successively lowered toward the axial portion 25. At a periphery of the bottom surface 26 of the cylindrical main body 20, there are provided four retaining projections 27. In the bottom surface 26 of the cylindrical main body 20 there are also formed four radial recesses 28 extending from the axial portion 25 to the retaining projections 27, into said recesses 28 being inserted partitions 37 of the reception housing 2 as will be explained later. The female terminals 8 are inserted into the terminal retaining holes 22 such that their terminal connecting portions 10 are aligned with the bottom surface 26 of the cylindrical main body 20. It should be noted that the recess 21 and flange 23 may be dispensed with.

Figure 7:
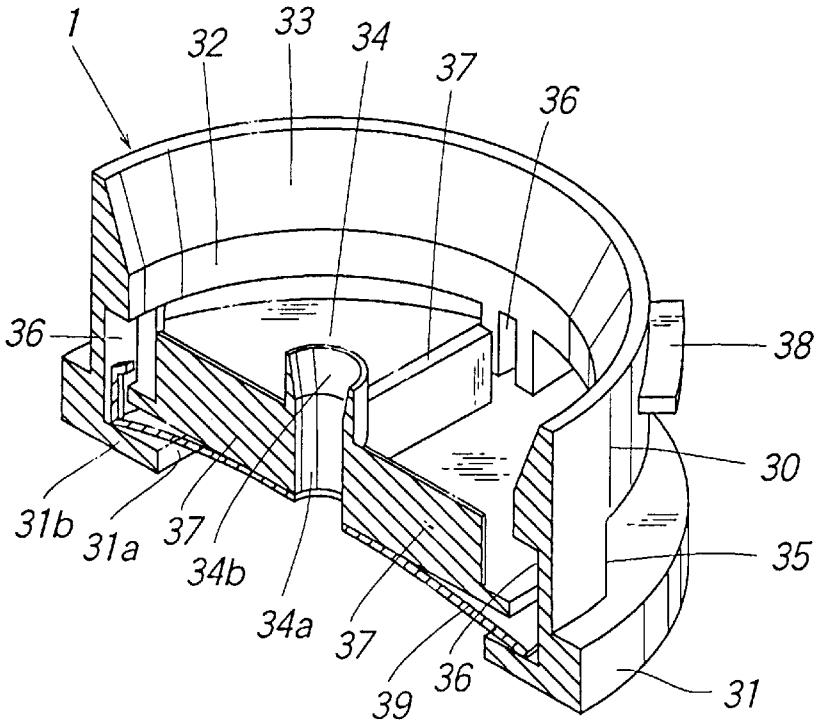
FIG. 7 is a perspective view illustrating the reception housing cut along a longitudinal axis.

As illustrated in FIG. 7, the reception housing 1 comprises a main body 30 and a bottom wall 31. The bottom wall 31 has a larger outer diameter than that of the main body 30, but the outer diameter of the bottom wall 31 may be identical with that of the main body 30. The main body 30 defines an inner space 32 into which the main body 20 of the insertion housing 3 is firmly inserted, and a tapered hole 33 into which the corresponding tapered portion 24 of the insertion housing 3 is inserted. At the center of the bottom wall 31, there is provided a tubular portion 34 arranged in the axial direction of the reception housing 1 and having a hole 34*a* into which is inserted the axial portion 25 of the insertion housing 3. At an upper portion of the hole 34*a*, there is formed a outwardly tapered guide portion 34*b* for guiding the front end of the axial portion 25.

At a lower portion of the main body 30, there are formed four cable introducing openings 35 through which the four end terminals 5 of the laminated flat cables 4 are inserted into the inner space 32 of the main body 30. The four openings 35 are provided mutually orthogonal directions, so that four end terminals 5 are inserted into the reception housing 1 from orthogonal directions in a plane perpendicular to the inserting direction of the insertion housing 3. In side walls defining the openings 35, there are formed locking recesses not shown for locking the end terminals 5 of the flat cable 4 as will be explained later. In the inner surface of the main body 30, there are formed four slits 36 which are communicated with a leaf spring retaining recess 31*a* defined by the lower surface of the bottom wall 34 and an inner flange 31*b*. Between the slits 36 and the tubular portion 34, there are formed four radial partitions 37 which are to be inserted into the corresponding radial recesses 28 formed in the bottom surface 26 of the insertion housing 3 when the insertion housing 3 is inserted into the reception housing 1. The partitions 37 divides the inner space 32 of the main body 30 into four sector compartments and the four end terminals 5 of the laminated flat cables 4 are accommodated in these sector compartments. On an outer surface of the main body 30, there are provided four engaging projections 38 which are brought into contact with the bracket 2. A leaf spring 39 made of a metal plate is provided such that a peripheral portion of the leaf spring is inserted into the circular recess 31*a* formed in the bottom wall 31.

Figure 8:
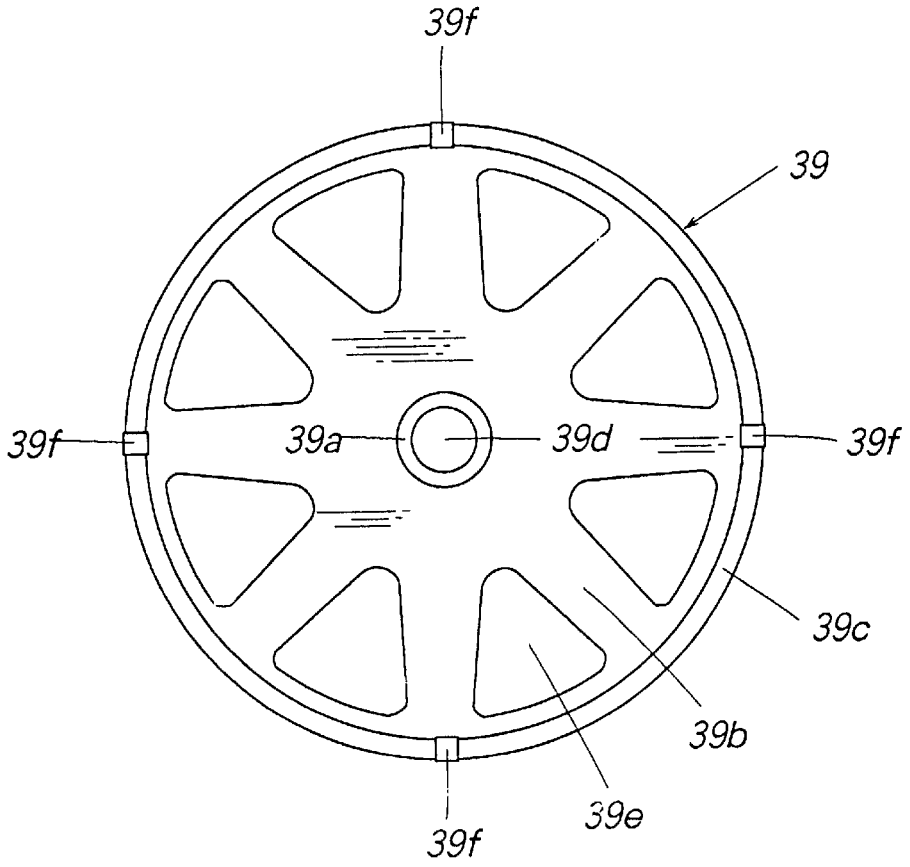
FIG. 8 is a plan view depicting a leaf spring.
Figure 9:
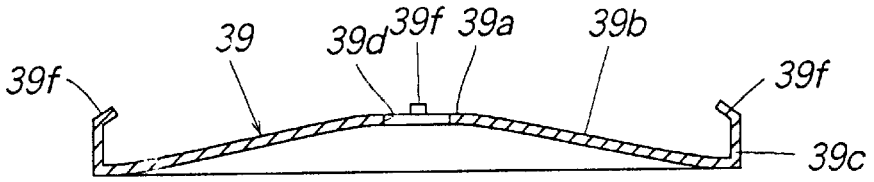
FIG. 9 is a cross sectional view showing the leaf spring cut along the longitudinal axis.

As illustrated in FIGS. 8 and 9, the leaf spring 39 comprises a flat central top portion 39*a*, an inclined portion 39*b* descending slowly from the top portion 39*a*, and a peripheral portion 39*c*. The top portion 39*a* of the leaf spring 39 has formed therein a hole 39*d* into which the axial portion 25 of the insertion housing 3 is forcedly inserted. The inclined portion 39*b* has formed therein a plurality of openings 39*e*. The peripheral portion 39*c* has four engaging strips 39*f*. The peripheral portion 39*c* of the leaf spring 39 inserted into the recess 31*a* of the reception housing 1 is urged against the upper surface of the inner flange 31*b* of the bottom wall 31 and the top portion 39*a* of the leaf spring 39 is urged against the lower surface of the bottom wall 31. It should be noted that the top portion 39*a* of the leaf spring 39 may be curved. Furthermore, it is not always necessary to form the openings 39*e*, but it is advantageous to form the openings 39*e* in order to perform a smooth kickback of the leaf spring.

Figure 10:
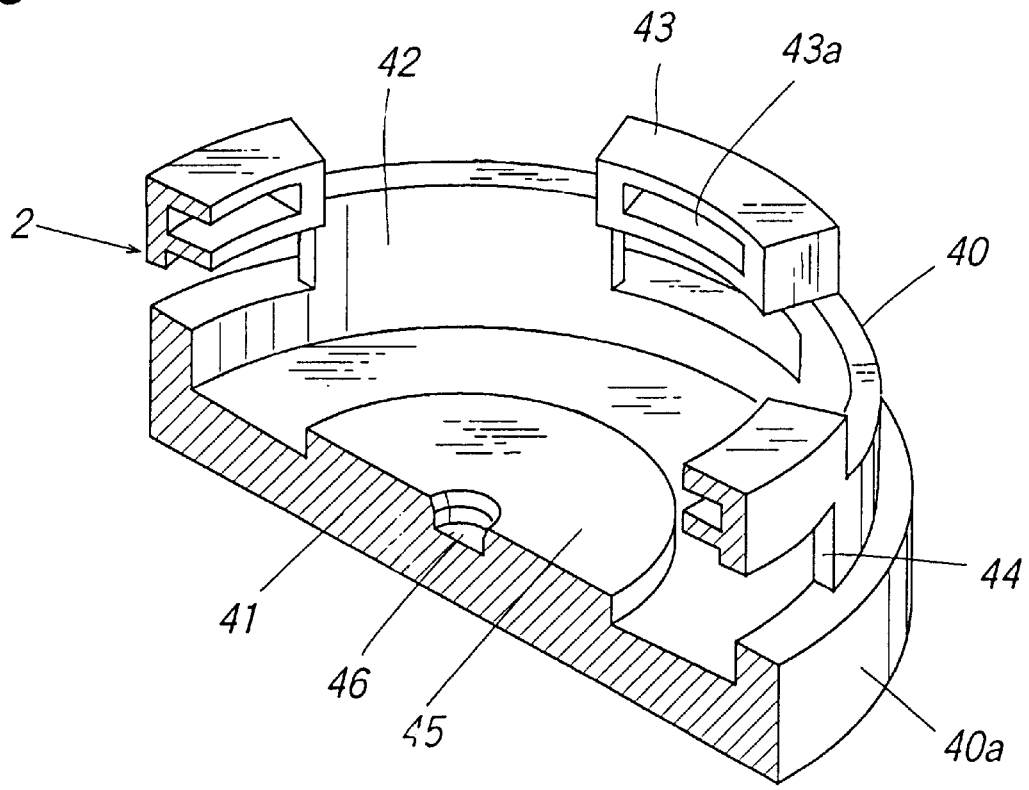
FIG. 10 is a perspective view showing the bracket cut along the longitudinal axis.

As shown in FIG. 10, the bracket 2 comprises a cylindrical main body 40 and a bottom wall 41, a lower portion 40*a* of said main body 40 having a larger thickness than that of the remaining portion. The main body 40 and bottom wall 41 define an inner space 42 which accommodates the main body 30 of the reception housing 1. At a front end of the main body 40 there are provided four engaging portions 43 in which engaging recesses 43*a* are formed. The engaging recesses 43*a* can receive the engaging projections 38 of the reception housing 1 in such a manner that the engaging projections can move within the engaging recesses in all directions. In the present embodiment, the lower portion 40 of the main body 40 has a larger thickness than the remaining portion, but it is not always necessary to have a larger thickness as long as the bottom wall 41 has a sufficient large mechanical strength.

In the main body 40, there are formed four cable introducing openings 44 through which the end terminals 5 of the flat cables 4 are inserted into the main body 40. On the upper surface of the bottom wall 41, there is formed a platform 45 whose diameter is sufficiently smaller than an inner diameter of the inner flange 31*b*. At a center of the platform 45, there is formed a hole 46 into which a front end of the axial portion 25 of the insertion housing 3 is to be inserted through the tubular portion 34 of the reception housing 1.

Figure 11:
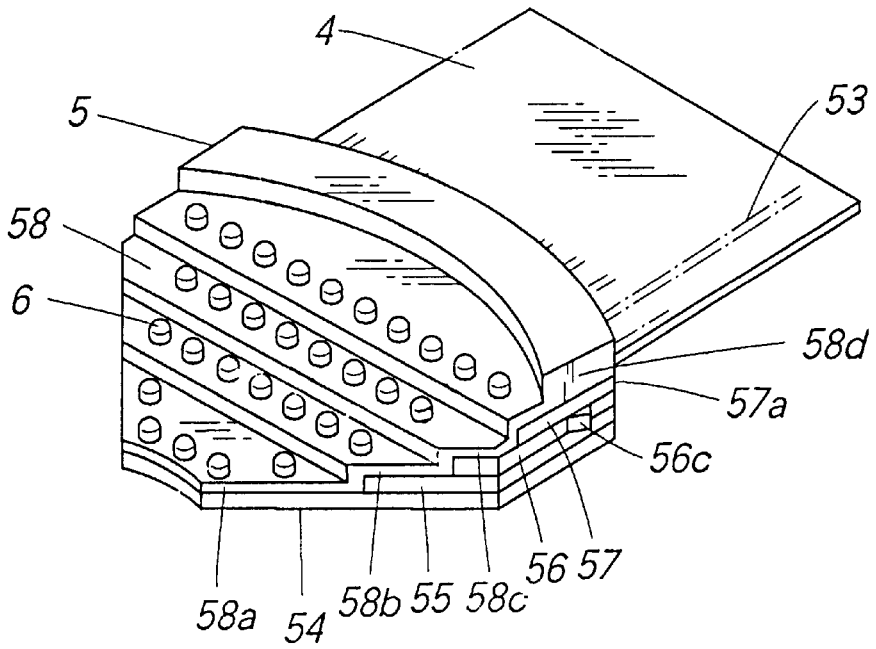
FIG. 11 is a perspective view illustrating the end terminal of the laminated flat cable.
Figure 12:
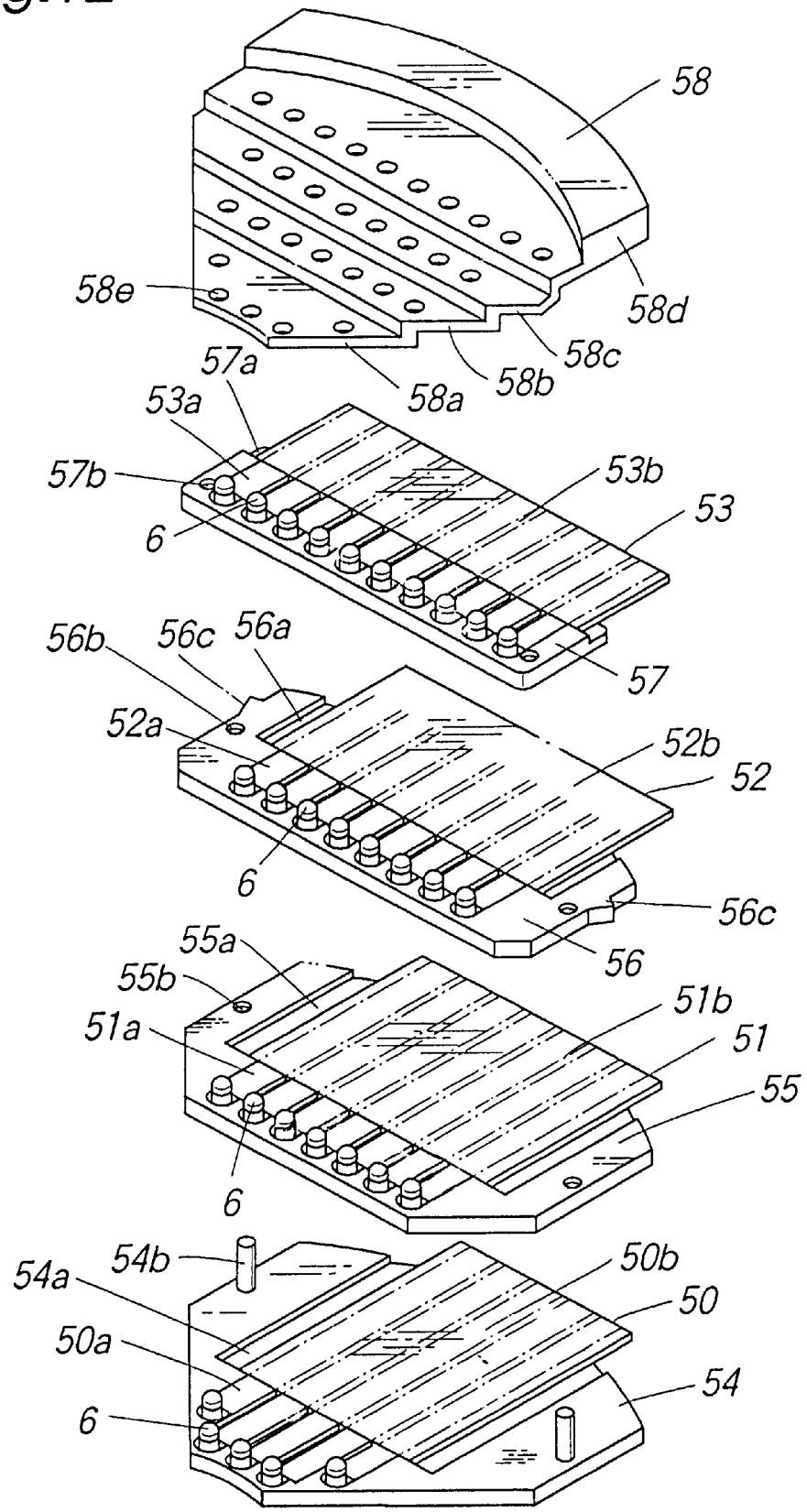
FIG. 12 is an exploded perspective view depicting the structure of the end terminal.
Figure 13:
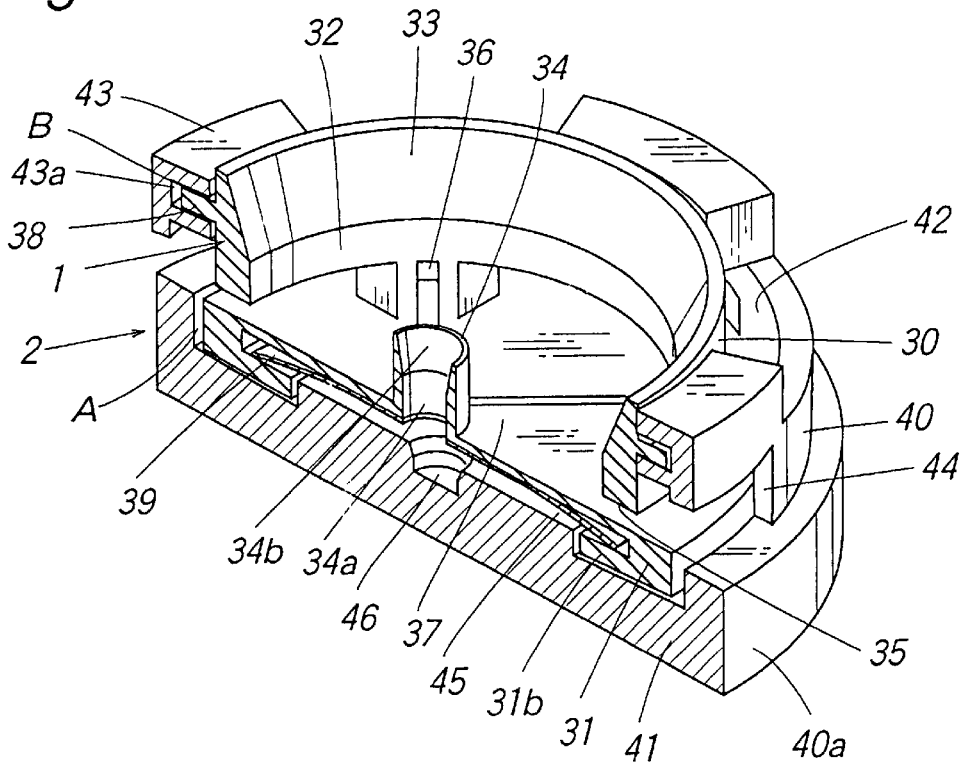
FIG. 13 is a perspective view showing an assembled condition of the reception housing and bracket cut along the longitudinal axis.

FIGS. 11 and 12 are perspective view and exploded perspective views, respectively showing the end terminal 5 of the laminated flat cable 4. The laminated flat cable 4 comprises four flat cables 50–53, and in each of the flat cables foil-shaped conductors 50*a*–53*a* are sandwiched between insulating sheets 50*b*–53*b*. The laminated flat cable 4 has a sufficient resiliency. A width of the flat cables 50–53 is gradually or successively decreased from the bottom one to the uppermost one. To each of the conductors 50*a*–53*a* of the flat cables 50–53 are fused respective male terminals 6.

In the end terminal 5 of the flat cable 4, four insulating plates 54–57 are stacked one upon the other such that front ends of these insulating plates are retarded outwardly. The front portion of the insulating plates 54–57 are shaped such that it can be inserted into the sector-shaped compartment defined by the adjacent partitions 37 of the reception housing 1. In upper surfaces of the insulating plates 54–57, there are formed recesses 54*a*–57*a* which accommodate parts of the insulating sheets 50*b*–53*b* and exposed conductors 50*a*–53*a* of the flat cables 50–53. On the upper surface of the lowermost insulating plate 54 are provided two pins 54*b*, and in the remaining insulating plates 55–57 are formed holes 55*b*–57*b* for passing the pins therethrough.

On the uppermost insulating plate 57 is provided an insulating cover 58 which has step portions 58*a*–58*d* corresponding to levels of upper surfaces of the insulating plates 54–57. In the insulating cover 58 there are formed a plurality of holes 58*e* through which the male terminals 6 provided on the insulating plates 54–57 are exposed in an assembled condition. The pins 54*b* are inserted into holes formed in a lower surface of the insulating cover 58 to bind the insulating plates 54–57 and insulating cover 58. The rear portion of the insulating plates 54–57 and insulating cover 58 is formed in such a shape that it is firmly engaged with the cable introducing opening 35 formed in the reception housing 1. On both sides of the intermediate insulating plate 56, there are formed locking projections 56*c* which are engaged with the locking recesses formed in both side walls defining the cable introducing opening 35 of the reception housing 1.

Upon assembling the reception housing 1 and bracket 2, at first the leaf spring 39 is fit into the spring retaining recess 31*a*. Then, the reception housing 1 is inserted into the bracket 2 while the engaging portions 43 of the bracket are bent outwardly, and the engaging projections 38 of the reception housing 1 are inserted into the engaging recesses 43*a* of the engaging projections. Then, the lower surface of the reception housing 1 is urged against the upper surface of the bottom wall 41 of the bracket 2 and the platform 45 is inserted into the inner flange 31*b*. Between the bracket 2 and the reception housing 1 there are formed a gap A viewed in the horizontal direction and a gap B viewed in the vertical direction. In this manner, the reception housing 1 can be moved horizontally and vertically. After that, the bracket 2 having the reception housing 1 secured thereto is fixed to the dash panel P.

Figure 14:
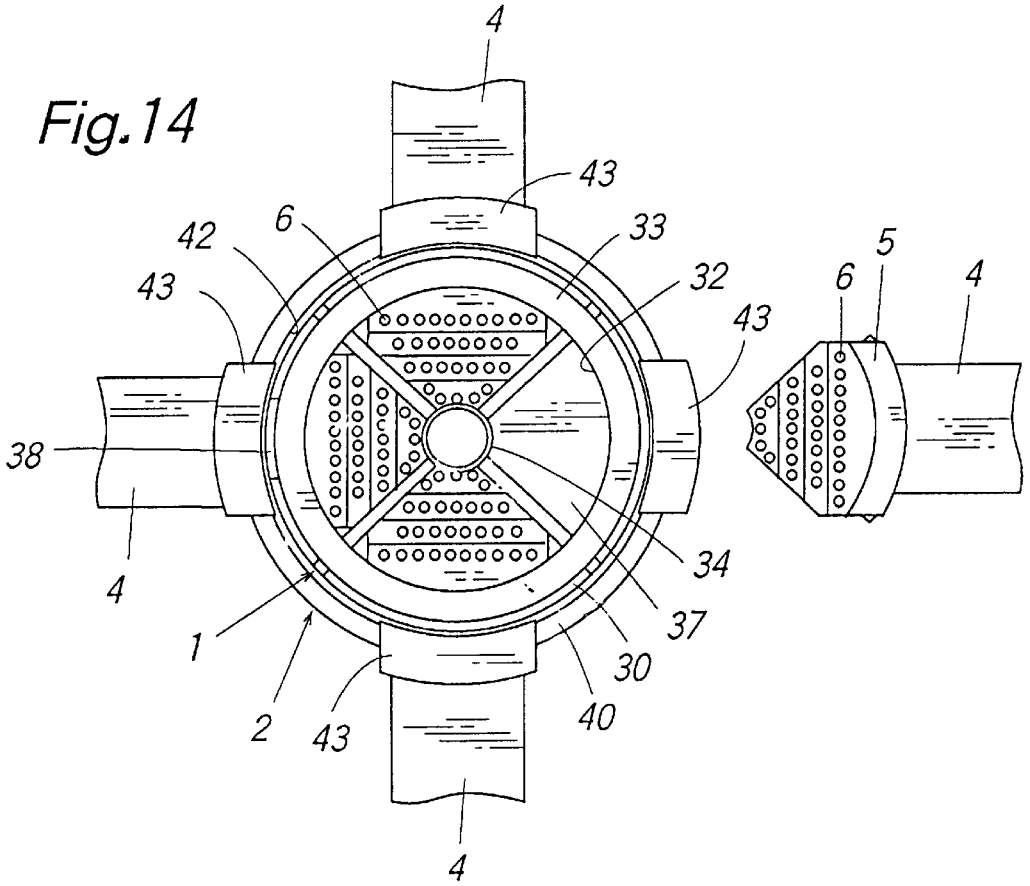
FIG. 14 is a plan view depicting the end terminals inserted into the reception housing.

In order to fix the bracket 2 and laminated flat cables 4 at given positions of the dash panel P as illustrated in FIG. 1, the bracket 1 is fixed to the dash panel P at a position corresponding to the insertion housing 3 secured to the instrument panel and the laminated flat cables 4 except for the folded portions 4*a* and end terminals 5 are adhered to the dash panel P. Then, the end terminals 5 of the laminated flat cables 4 are inserted into the inner space 32 of the reception housing 1 through the cable introducing openings 44 formed in the bracket 2 and cable introducing openings 35 formed in the reception housing 1. Since the laminated flat cables 4 have the folded portions 4*a*, the end terminals 5 can be moved in all directions to improve the easy insertion of the end terminals. In this manner, the end terminal 5 of the laminated flat cable 4 can be inserted into the sector-shaped compartments within the space 32 until the side walls of the end terminal are urged against the partitions 37 of the reception housing 1 as shown in FIG. 14. In this condition, the locking projections 56*c* of the end terminal 5 are inserted into the locking recesses formed in the side walls of the cable introducing opening 35. During this inserting operation, the portion of the laminated flat cable 4 between the folded portion 4*a* and the end terminal 5 can freely move in accordance with the movement of the reception housing 1. In the manner explained above, four end terminals 5 may be inserted into the space 32 of the reception housing 1 from mutually orthogonal directions in a plane perpendicular to the inserting direction of the insertion housing 3.

Figure 15:
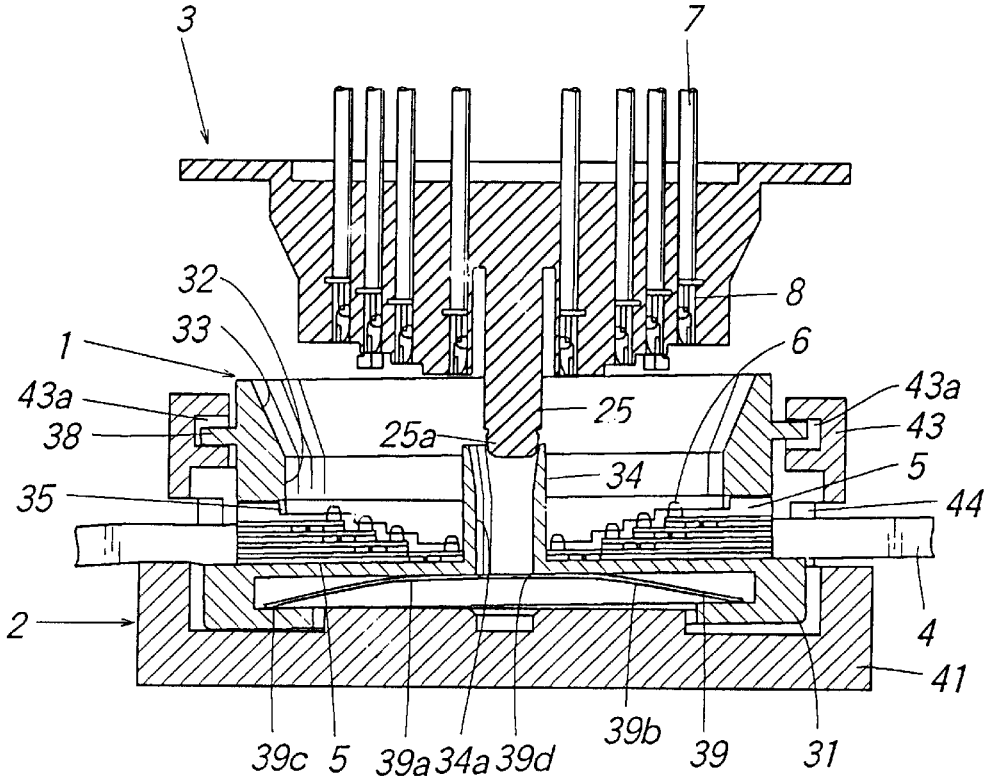
FIGS. 15, 16 and 17 are cross sectional views illustrating successive conditions during the insertion of the insertion housing into the reception housing.

As depicted in FIG. 15, upon securing the instrument panel to the dash panel P, the axial portion 25 of the insertion housing 3 is positioned at the guide hole 34*b* of the tubular portion 34 of the reception housing 1. In this case, in general, the insertion housing 3 is not axially aligned with the reception housing 1, and therefore the reception housing 1 is inclined and at least one of the engaging projections 38 is urged against the lower surface of the engaging recess 43*a* and at least one of the remaining engaging projections is urged against the upper surface of the engaging recess. Similarly, one of the end terminals 5 moves upwardly within the cable introducing openings 35 and 44.

Figure 17:
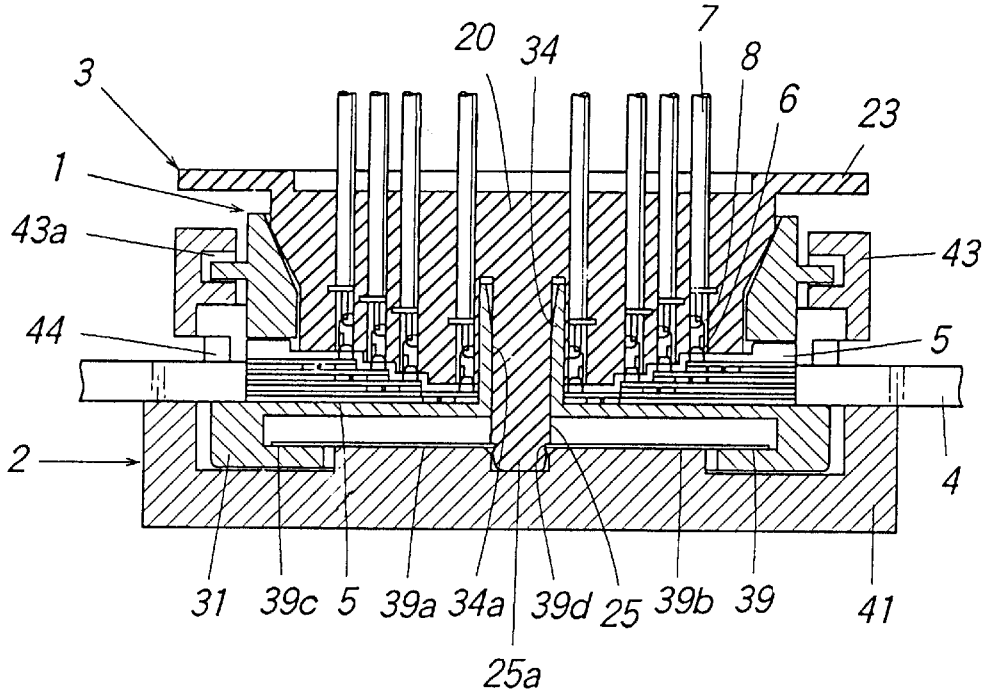

When the instrument panel is pushed toward the connector, the axial portion 25 of the insertion housing 3 is inserted into the hole 34*a* of the tubular portion 34 of the reception housing 1 and the reception housing 1 is swung into the horizontal posture. Then, the partitions 37 of the reception housing 1 are inserted into the recesses 28 of the insertion housing 3, and the guide portion 25*a* of the axial portion 25 is forcedly inserted into the hole 39*d* of the leaf spring 39. When the instrument panel is further pushed, the periphery of the hole 39*d* of the leaf spring 39 is fit into the ring-shaped recess 25*b*, the top portion 39*a* is pressed downward by means of the axial portion 25, and the leaf spring 39 is temporally deformed into the flat posture as illustrated in FIG. 17.

Figure 18:
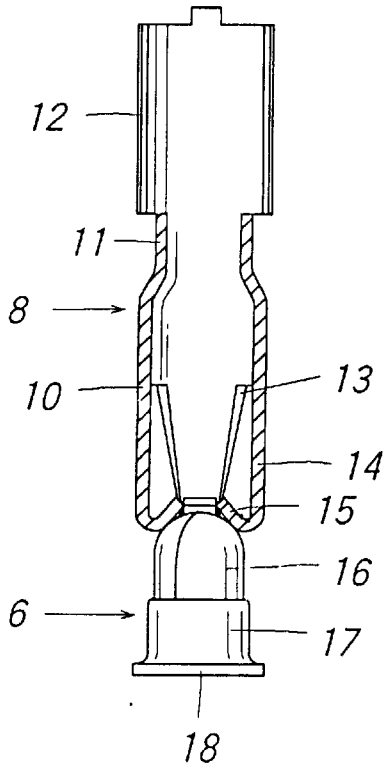
FIG. 18 is a cross sectional view showing a contacting condition of the male and female terminals in the condition shown in FIG. 17.
Figure 19:
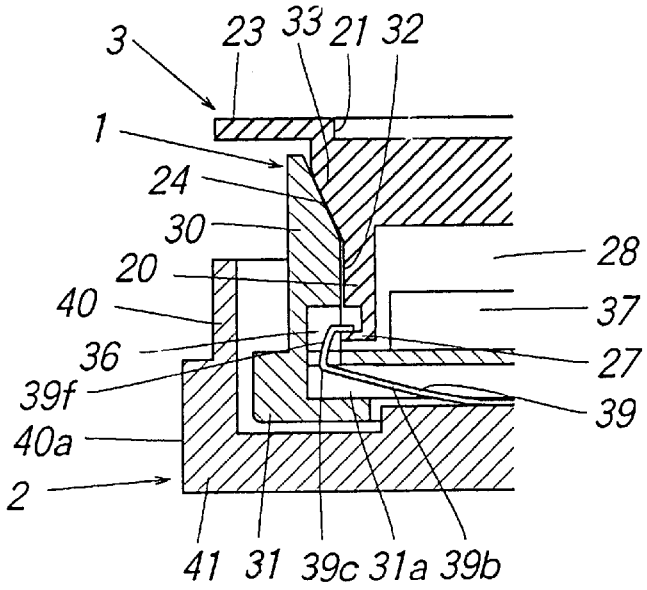
FIG. 19 is a cross sectional view illustrating a part of the finally assembled reception housing and insertion housing.
Figure 20:
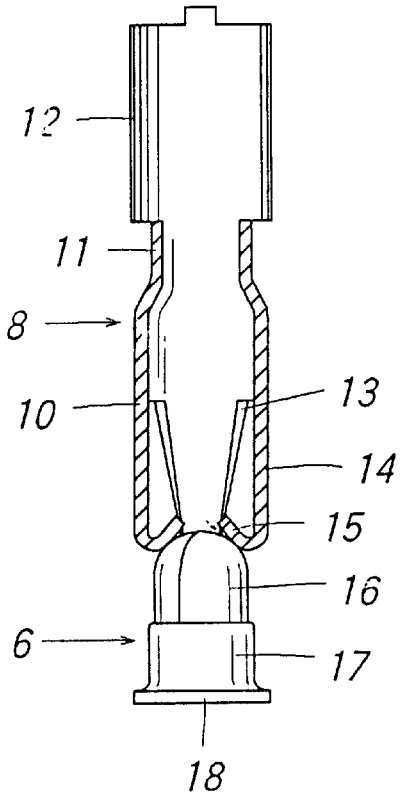
FIG. 20 is a cross sectional view depicting a coupling of the male and female terminals in the finally assembled condition.

In this condition, the connecting portion 16 of the male terminal 6 is brought into contact with the resilient strips 15 as shown in FIG. 18. When the instrument panel is finally pushed, the top portion 39*a* of the leaf spring 39 is pushed downward by the axial portion 25 and the leaf spring 39 is turned over as shown in FIG. 4. That is to say, the top portion 39*a* of the leaf spring 39 is faced downward and is urged against the bottom wall 41 of the bracket 2. Then, the reception housing 1 is resiliently pushed against the insertion housing 3 by means of the peripheral portion 39*c* of the leaf spring 39 due to the restoring force of the leaf spring. At the same time, as depicted in FIG. 19, the engaging portions 39*f* of the leaf spring 39 are bent inwardly and are engaged with the engaging projections 27 of the insertion housing 3 through the slits 36 formed in the reception housing 1. In this condition, the connecting portion 15 of the male terminal 6 is fully inserted into the space defined by the resilient strips 15 of the female terminal 8. In this manner, all the male terminals 6 are simultaneously connected to the corresponding female terminals 8 in a positive manner.

Figure 16:
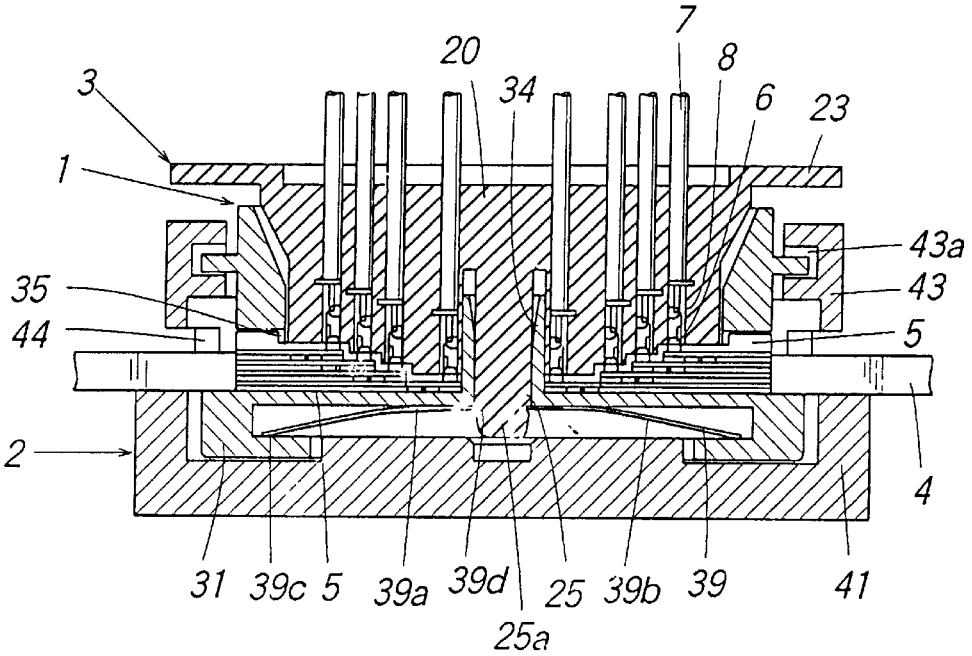

When the instrument panel is removed from the dash panel P, the insertion housing 3 is pulled out of the reception housing 1. Since the axial portion 25 of the insertion housing 3 is fit in the hole 39*d* of the leaf spring 39, the center portion of the leaf spring is pulled and is turned over again into the original posture in which the top portion 39*a* is faced upwardly as shown in FIG. 16. In this manner, the insertion housing 3 can be easily removed from the reception housing 1.

As explained above, in the connector of the present embodiment, all the male terminals 6 can be inserted into the reception housing 1 by inserting the end terminals 5 of the laminated flat cables 4 into the cable introducing openings 35 of the reception housing 1, and all the male terminals can be simultaneously connected to the female terminals 8 which are connected to the respective electric wires 7. In this manner, the core conductors of the flat cables 4 can be connected to the respective electric wires 7 in an easy and positive manner. Moreover, since all the end terminals 5 of the laminated flat cables 4 have the same configuration, the end terminals can be formed easily. Moreover, since the end terminals 5 are inserted into the reception housing 1 from the side direction perpendicular to the inserting direction of the insertion housing 3, a necessary space for coupling the reception housing 1 and insertion housing 3 with each other can be reduced.

In the above embodiment, the end terminals 5 of the laminated flat cables 4 have the same configuration, but according to the invention, they may be formed to have different configurations. Then, erroneous connection may be effectively prevented. The rear portion of the insulating plates 54–57 and insulating cover 58 is formed to be firmly fit into the cable introducing opening 35 of the reception housing 1, but according to the invention a suitable sealing member may be inserted between these portions in order to improve the hermetic seal. Furthermore, the locking recesses and locking projections 56*c* are formed on the side walls of the cable introducing opening 35 of the reception housing 1 and end terminal 5 of laminated flat cable 4, but they may be provided oppositely or may be formed on upper and lower surfaces.

In the above embodiment, the female terminals 8 are provided on the bottom surface 26 of the insertion housing 3 whose level is changed in a stepwise manner toward the central axial portion 25 and the male terminals 6 are provided on the upper surface of the end terminal 5 of the laminated flat cable 4 whose level is changed in a corresponding stepwise manner. Therefore, a distance between adjacent connecting portions 10 of the female terminals 8 can be increased even if a distance between adjacent connecting portions 10 viewed in the plane which is perpendicular to the inserting direction of the insertion housing 3, and thus an influence of heat generated at the contact between the terminals 6 and 8.

Further, the male terminals 6 may be arranged substantially equidistantly in a zigzag manner. Then, adjacent male terminals 6 can be electrically isolated from each other much more effectively. The upper surface of the end terminal 5 and the lower surface of the insertion housing may be inclined in a continuous or linear manner instead of in a stepwise manner.

In the above embodiment, since the laminated flat cable 4 includes at least one folded portion 4*a*, the reception housing 1 can be moved in all directions freely, and thus upon inserting the insertion housing 3 into the reception housing 1, the reception housing can be moved in accordance with the insertion housing. In this manner, the insertion housing 3 can be easily inserted into the reception housing 1. In the above embodiment, the folded portion 4*a* of the laminated flat cable 4 is formed to be perpendicular to the longitudinal direction of the cable, but may be inclined.

As explained above, in the connector according to the invention, a number of connecting terminals connected to a number of conductors of flat cables are provided on the end terminal, and the end terminal is inserted into the reception housing through the cable introducing opening. Therefore, a large number of connecting terminals can be easily and efficiently accommodated in the reception housing.

What is claimed is:

1. A connector comprising a reception housing accommodating a number of first connecting terminals connected to a number of conductors of a plurality of flat cables and an insertion housing accommodating a number of second connecting terminals connected to a number of electric wires, said first and second connecting terminals being coupled with each other by inserting said insertion housing into said reception housing, wherein said reception housing includes a plurality of compartments formed within an inner space of said reception housing, and a plurality of end terminals having said number of first connecting terminals secured thereto are inserted into said plurality of compartments from side directions perpendicular to an axial direction of said reception housing in which said insertion housing is inserted into said reception housing, and said first connecting terminals are provided on said end terminals such that said first connecting terminals extended perpendicularly to said side directions from which said end terminals are inserted into said compartments of said reception housing.

2. A connector according to claim 1, wherein said first connecting terminals are provided on the end terminals such that the first connecting terminals are directed perpendicularly to a plane of the flat cable.

3. A connector according to claim 1, wherein in each of said end terminals, the first connecting terminals are aligned along a plurality of lines, and in each of said lines the first connecting terminals are arranged substantially equidistantly.

4. A connector according to claim 1, wherein each of said first connecting terminals is formed by a male terminal and each of said second connecting terminals is formed by a female terminal which engages with said male terminal.

5. A connector comprising a reception housing accommodating a number of first connecting terminals connected to a number of conductors of a plurality of flat cables and an insertion housing accommodating a number of second connecting terminals connected to a number of electric wires, each of said plurality of flat cables including at least one folded portion, said first and second connecting terminals being coupled with each other by inserting said insertion housing into said reception housing, wherein said reception housing includes a plurality of compartments formed within an inner space of said reception housing, and a plurality of end terminals having said number of first connecting terminals secured thereto are inserted into said plurality of compartments from side directions perpendicular to an axial direction of said reception housing in which said insertion housing is inserted into said reception housing.

6. A connector comprising a reception housing accommodating a number of first connecting terminals connected to a number of conductors of a plurality of flat cables and an insertion housing accommodating a number of second connecting terminals connected to a number of electric wires, said first and second connecting terminals being coupled with each other by inserting said insertion housing into said reception housing, wherein said reception housing comprises four sector-shaped compartments formed within an inner space of said reception housing, said number of first connecting terminals include four sector-shaped end terminals that are inserted into said four sector-shaped compartments from side directions perpendicular to an axial direction of the reception housing and from mutually orthogonal directions relative to a plane perpendicular to a direction for inserting said insertion housing into said reception housing.

7. A connector according to claim 6, wherein said reception housing comprises four radial partitions defining said four sector-shaped compartments, and said sector-shaped end terminals are inserted into the compartments until side walls of the end terminals abut said partitions.

8. A connector according to claim 6, wherein said reception housing includes a plurality of openings through which said end terminals are inserted into said compartments.

9. A connector according to claim 8, wherein each of said end terminals includes a locking mechanism for locking the end terminal to the reception housing in the inserted condition.

10. A connector comprising a reception housing accommodating a number of first connecting terminals secured to a number of conductors of a plurality of laminated flat cables and an insertion housing accommodating a number of second connecting terminals connected to a number of electric wires, said first and second connecting terminals being coupled with each other by inserting said insertion housing into said reception housing, wherein said reception housing comprises four sector-shaped compartments formed within an inner space of said reception housing, said number of first connecting terminals include four sector-shaped end terminals that are inserted into said four sector-shaped compartments from side directions perpendicular to an axial direction of said reception housing, and a plurality of first connecting terminals groups connected to respective laminated flat cables are provided on a contact surface of the end terminal, said contact surface being inclined with respect to a plane perpendicular to an inserting direction of said insertion housing.

11. A connector according to claim 10, wherein said inclined contact surface is formed by a plurality of step portions.

12. A connector according to claim 11, wherein a thickness of said plurality of step portions of the end terminal is successively increased from a distal end to a proximal end of the end terminal.

* * * * *